United States Patent [19]

Hosker

[11] 4,117,613

[45] Oct. 3, 1978

[54] PICTURE DISPLAY ASSEMBLY

[76] Inventor: Thomas M. Hosker, 17 Dona St., Lynn, Mass. 01904

[21] Appl. No.: 782,422

[22] Filed: Mar. 29, 1977

[51] Int. Cl.[2] ..... G09F 1/12

[52] U.S. Cl. ..... 40/152.1; 40/158 R

[58] Field of Search ..... 40/152, 156, 158 R, 40/10 R, 152.1

[56] References Cited

U.S. PATENT DOCUMENTS

| | | | |
|---|---|---|---|
| 344,638 | 5/1969 | Jahn | 40/158 |
| 396,536 | 1/1889 | Brown | 40/104.19 |
| 774,694 | 11/1904 | Post | 40/122 |
| 1,594,339 | 7/1926 | Robertson | 40/152.1 |
| 2,082,082 | 6/1937 | Scharling | 40/152.1 |
| 2,505,506 | 4/1950 | Sayre | 40/159 X |
| 3,611,604 | 10/1971 | Saltzman | 40/152 |
| 3,731,413 | 5/1973 | Hooper | 40/152 |
| 3,873,405 | 5/1975 | Wilkes | 40/158 R |

*Primary Examiner*—Louis G. Mancene
*Assistant Examiner*—Wenceslao J. Contreras
*Attorney, Agent, or Firm*—Kenway & Jenney

[57] ABSTRACT

A front-loading picture frame assembly of the box type which includes a top panel having openings through one or more of which pictures can be inserted. The openings are spaced sufficiently closely that the pictures when inserted can be manipulated into positions in which each picture is framed by an opening. The openings may be of any desired shape and distributed across the panel symmetrically or otherwise. Behind the top panel is a backing system including a resilient layer which urges the pictures into frictional engagement with said top panel. The backing member may also include pressure-distributing cuts which equalize pressure upon the pictures. The frame may also include an easel stand or a hanging member. A separate decorative outer enclosing frame may be used in place of the simpler box type enclosure.

12 Claims, 5 Drawing Figures

PICTURE DISPLAY ASSEMBLY

BACKGROUND OF THE INVENTION

Traditionally, pictures have been displayed in frames which generally include a decorative border, a transparent glass or plastic sheet through which the picture may be viewed, a border which may serve to conceal the edges of the picture or to block out unwanted portions of the picture, a backer usually of pasteboard and some means to hold the assembly of elements in the frame.

There have been numerous efforts to improve upon and simplify picture framing. Slotted frames into which the various elements may be inserted and frames hinged in various ways to open and receive the elements and then close to lock the elements in place are among the common expedients that have become available.

However, there has been an explosive growth in amateur photography in recent years which was accelerated even more with the advent of instant or self-developing pictures, particularly those in color. Individual or even group-framing of such pictures in the traditional manner or with commercially available frame devices is unsatisfactory not only from the cost standpoint but also because the sheer volume of pictures accumulated even by a hobbyist would require an intolerable amount of effort.

The present invention is concerned with filling the need for an inexpensive, decorative, easy-loading, pre-assembled display assembly for framing pictures.

BRIEF SUMMARY OF THE INVENTION

The display assembly of the invention is basically a box-like structure having a top panel in which picture-framing openings are formed. At least one of the openings is large enough and of proper configuration to permit the insertion of the pictures and the openings are suitably distributed and of appropriate size to permit each picture to be manipulated into a position where it is framed by its associated opening. Behind the pictures is a resilient backer which holds the pictures in light frictional engagement with the underside of the panel so that they are retained in framed relationship with their respective openings. The display assembly may be hung on the wall by means of eyelets or openings provided on a base or bottom member which is held in fixed spaced relationship to the top panel. Alternatively, an easel stand may be fixed to, or made integral with the bottom member so that the display assembly may stand by itself in a near-perpendicular viewing plane.

The backing member may include a relatively stiff insert board immediately behind the pictures and a layer or pieces of resilient foam between the insert board and the bottom member. To equalize pressure upon the pictures, "oil-can" effects which might occur in the insert board are relieved by the forming of one or more slits in the insert board. Friction to hold the pictures firmly in place relative to their associated openings may be enhanced by lightly abrading or cross-hatching either the underside of the top panel or the upper side of the insert board, particularly in those areas immediately about the openings.

Presently preferred embodiments of the invention are shown in the appended drawing in which:

DETAILED DESCRIPTION OF THE PREFERRED EMBODIMENT

Figure 1:
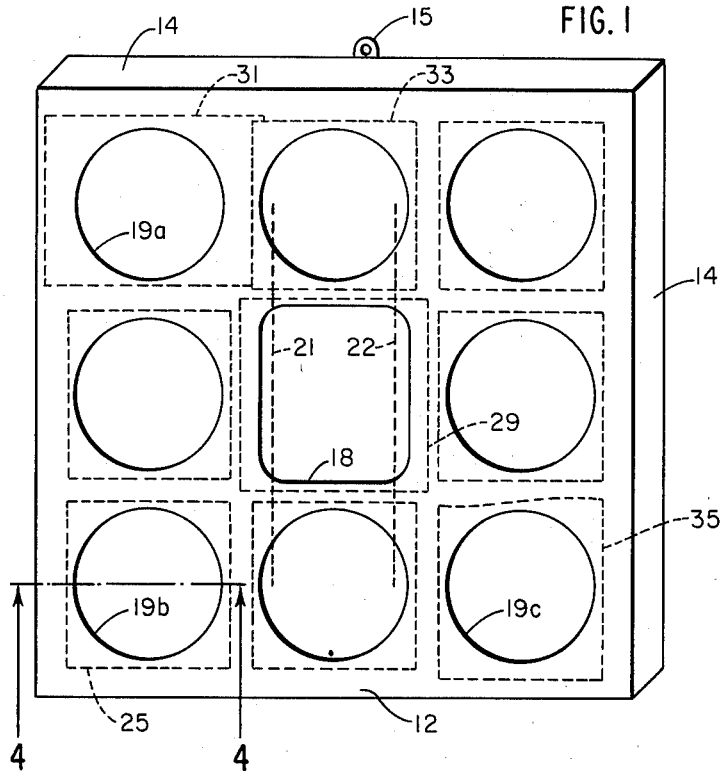
FIG. 1 is a front perspective view of a form of the display assembly of the invention.
Figure 2:
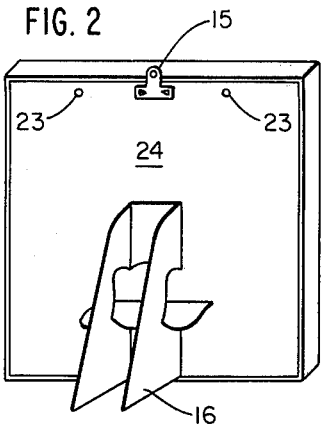
FIG. 2 is a rear perspective view in which the easel mount is shown.

A simple inexpensive form of the invention is shown in FIGS. 1 and 2. It includes a top panel 12 which forms a part of a box-like cover having down-turned edges 14. Fitted into the cover is a mating box-like bottom member having a flat surface 24 and up-turned edges 26. The box-like cover and bottom thus enclose all of the components of this form of the invention. The display assembly is designed to be hung on the wall by means of a clip 15 attached to the bottom surface 24. Alternatively, as seen in FIG. 2, the assembly may be utilized free-standing at a comfortable viewing angle near vertical by means of an erectable easel mount 16 attached to the bottom surface 24. Also, for wall hanging, the display assembly may be provided with suitable eyelets or openings 23 disposed in the bottom surface 24.

The top panel 12 has a number of picture-framing openings formed through its surface and these openings may be symmetrically arranged as shown. The central opening 18 may, for example, be generally rectangular and surrounded by a group of circular openings **19*a*, 19*b*, 19*c*, etc. The openings are of sufficient size and so disposed that a picture may be inserted through the rectangular opening 18 and manipulated into framed relationship with any of the other openings 19*a*, 19*b*, etc. For such front loading to be feasible, in the case of a generally rectangular opening such as the opening 18, a minor dimension of the pictures to be framed by the circular openings must be less than a diagonal dimension of the rectangular opening 18** and such a diagonal dimension will be referred to as a major dimension. Minor dimensions of pictures to be framed by openings other than the largest may be the short dimension of a rectangular picture, the minor axis of an oval picture or the like.

Pictures of various sizes may be framed as shown and some overlapping is tolerable, as is illustrated by the pictures 31 and 33 shown in dotted outline behind the opening **19*a* and the opening adjacent to opening 19*a*. By suitable choice of pictures and opening size, a cropped picture such as picture 35 shown in dotted outline behind the opening 19*c* may be framed. Also, of course, pictures of different shapes and sizes may be framed in the same manner as is indicated behind the opening 19*a***.

Figure 3:
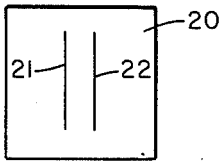
FIG. 3 provides detail on the pressure-equalizing insert board which backs the pictures in the display assembly.
Figure 4:
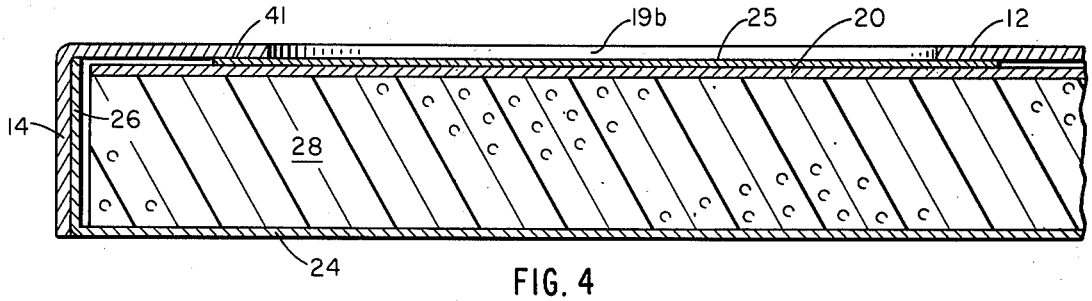
FIG. 4 is a section of a corner of the embodiment of FIG. 1 taken along line 4—4 and illustrating component disposition.

Immediately behind the pictures, as may be seen in FIG. 4, an insert board 20 is disposed. Visible in FIG. 4 are the opening **19*b* framing a picture 25 backed by the insert board 20, a feature of which is shown in FIG. 3. To prevent the insert board 20 from bulging in "oil can" fashion or otherwise exerting unequal pressure upon the backs of the pictures, a pair of parallel slits 21 and 22 may be die-cut in the insert board. A preferred location for the slits 21 and 22 which has proven effective in equalizing pressure is roughly adjacent the projected area of the rectangular central opening 18. (See FIG. 1). The insert board 20 is generally co-extensive with the top panel 12** and similar cuts or slits are feasible in other areas to insure pressure equalization.

Turning to FIG. 4, the source of the pressure for urging the insert board 20 against the backs of the pictures is illustrated. In a simple embodiment, as noted above, the bottom box-like member 24 having upturned edges 26 is fitted into the top box-like cover. The bottom member may be fixed in the position shown in FIG. 4 by any suitable means, such as an adhesive or metal fastener. Within the bottom member 24 there is illustrated a layer of resilient material 28, which substantially fills the bottom member 24. The thickness of the layer 28 is chosen to be slightly greater than the available space between the insert board 20 and the inner surface of the bottom member 24, such that when the layer 28 is enclosed in the position shown, a light but perceptible pressure is exerted against picture 25 by the insert board 20. The layer 28 is preferably substantially co-extensive in area with the interior of the bottom member 24 but other resilient members of similar thickness such as an open-mesh of resilient material or suitably positioned strips of resilient material may be utilized.

Figure 5:
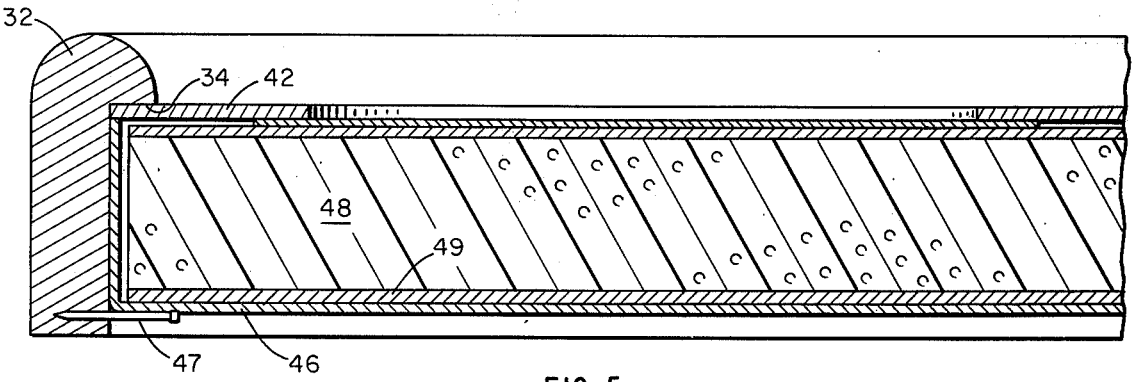
FIG. 5 is a sectional view analogous to that of FIG. 4 but involving a wooden framed version of the invention.

FIG. 5 illustrates an alternative embodiment of the invention in which a surrounding decorative frame 32 of wood or other suitable material is used. The decorative frame may have a lip or shoulder 34 formed peripherally around its top inner border. The other elements of this form of display assembly may be similar to those of the embodiment of FIGS. 1 and 2 or the top panel 42 may simply be a planar element having no down-turned edges. Again, however, a resilient element 48 may be disposed behind the top panel 42 to urge an insert board 40 against the pictures being framed by the top panel 42. The bottom member may also be the same as the bottom member 24 of the previously described embodiment, or, for increased structural integrity, the flat surface 46 of the bottom box-like member may contain a reinforcing board 49. The entire assembly may be retained in the wooden frame against the border 34 by means of simple fasteners 47 inserted or driven into the wooden frame 32 beneath the bottom member 44.

In order to prevent pictures from sliding from their framed positions behind the top panel, further provision in the form of abraded areas adjacent the openings on the underside of the top panel may be used to increase friction. Such an area is shown in FIG. 4 at the edge 41 of the opening **19*b*. In some instances, similar friction-increasing areas may be formed on the insert board at suitable positions beneath the pictures being framed, or the insert board may have a cross-hatched surface at appropriate points or overall. Similarly, of course the underside of the panels 12 and 42** may be composed of or treated to increase friction in the same manner.

The top panel in either of the embodiments is preferably made from pasted paper-board or chipboard laminated with a decorative paper or plastic and the openings for framing the pictures are die-cut after the top is formed. For aesthetic reasons, any rectangular or square opening may have rounded corners. The shapes of the various openings may be varied in that any desired combination of generally rectangular, square or non-rectangular, such as circular or oval openings may be used. It is necessary only that a major dimension, such as the diagonal dimension of one or more of the larger openings (when that chosen is a square or rectangular opening) be greater than a minor dimension of any of the other pictures to be framed. In this fashion, all pictures are insertable through the larger opening, and may then be manipulated into proper framed position.

The bottom member of the display assembly may be made from vat-lined board scored and bent to the desired size and glued or otherwise fixed in place in the cover member after the insert board and resilient element are positioned. The insert board may be made of bleached manilla and the preferred pressure equalizing slits may be formed along lines approximately a quarter inch inward from the side of the central opening. A preferred resilient material is polyurethane foam, although many other resilient materials are suitable.

In one specific structure, the central opening measures 2 15/16 inches by 3 7/16 inches. The circular openings surrounding the rectangular opening are of 3-inch diameter. With such opening dimensions and typical instant color snapshots, all of the pictures may be inserted through the central opening and manipulated into framed position where they are held principally by the pressure exerted by the resilient backer. As noted above, the additional friction which may be needed is provided by the treatment of the members between which the pictures are held, especially in the area adjacent the edges of the framing openings.

What is claimed is:

1. In an assembly for framing a plurality of pictures the combination of a top panel having a like plurality of openings formed therethrough, the area of each said opening being less than that of a picture to be framed thereby, at least one of said openings having a major dimension which may be the diagonal thereof greater in size than a minor dimension of any of said plurality of said pictures whereby said pictures may be inserted through said one of said openings, and resilient backing means disposed behind but not connected to said top panel at any points adjacent said openings said resilient backing means urging said pictures into frictional engagement with the underside of said top panel.

2. In an assembly for framing a plurality of pictures as defined in claim 1, the combination wherein the openings formed in said top panel are spaced sufficiently closely to permit each of said pictures to be manipulated into framed relationship with one of said openings.

3. In an assembly for framing a plurality of pictures as defined in claim 2, the combination wherein said resilient backing means comprises a relatively stiff insert board substantially co-extensive in area with said top panel normally disposed immediately beneath said top panel, a bottom member substantially co-extensive in area with said top panel and in fixed spaced relationship thereto, and a quantity of resilient material disposed between said bottom member and said insert board and having sufficient thickness to urge said insert board and said pictures toward said top panel.

4. In an assembly for framing a plurality of pictures as defined in claim 3, the combination wherein said quantity of resilient material comprises a layer of foam substantially co-extensive in area with said insert board.

5. In an assembly for framing a plurality of pictures as defined in claim 3 the combination wherein said insert board has at least one slit formed therethrough to equalize across the area thereof pressure exerted to urge said pictures against the underside of said top panel.

6. In an assembly for framing a plurality of pictures as defined in claim 4, the combination of means associated with said bottom member to permit hanging of said assembly.

7. In an assembly for framing a plurality of pictures as defined in claim 4, the combination therewith of an easel attached to said bottom member to permit standing of said assembly on end with said top panel disposed at a small angle to the vertical.

8. In an assembly for framing a plurality of pictures as defined in claim 4, the combination wherein the underside of said top panel is cross-hatched at least in the areas immediately adjacent said openings to increase friction.

9. An assembly for framing a plurality of pictures comprising a generally box-like structure including a bottom member having up-turned edges, a layer of resilient foam contained in said bottom member, an insert board disposed upon and substantially co-extensive in area with said layer, and a cover including a top panel and down-turned edges substantially overlapping the edges of said bottom member and enclosing the contents thereof, said cover and said bottom member being fastened together, said top panel having a plurality of openings of predetermined area formed therein, said predetermined area of each said opening being less than that of one of said plurality of pictures to be framed thereby, at least one of said openings having a dimension which may be a diagonal greater than that of one of the dimensions of said plurality of pictures and said openings being spaced sufficiently closely and said insert board being free of any interconnection with said top panel at points adjacent said openings to permit manipulation of each of said plurality of pictures into framed relationship with one of said openings, the thickness of the contents of said bottom member being sufficient to cause said layer of foam to urge said insert board against said plurality of pictures whereby said pictures are frictionally engaged by said top panel.

10. An assembly for framing a plurality of pictures as defined in claim 9 wherein said one of said openings is rectangular in shape, one or more of the remainder of said openings being non-rectangular in shape.

11. An assembly for framing a plurality of pictures as defined in claim 9 wherein said plurality of openings is formed in a symmetrical array through said top panel.

12. In an assembly for framing a plurality of pictures as defined in claim 4, the combination therewith of a wooden frame having an internal shoulder formed therein adjacent its top surface, said top panel bearing peripherally against said shoulder, and means for retaining said bottom member fixed within said wooden frame.

* * * * *